US006572084B1

(12) United States Patent
Ivanovich et al.

(10) Patent No.: US 6,572,084 B1
(45) Date of Patent: Jun. 3, 2003

(54) METHOD FOR PRODUCTION OF FOAM AND DEVICE FOR REALIZING THE SAME

(75) Inventors: Drobyshev Vyacheslav Ivanovich, 66 Malaya Filevskya Str., Apt 72, Moscow (RU), 121433; Kadushin Pavel Nikolaevich, Moscow (RU)

(73) Assignee: Drobyshev Vyacheslav Ivanovich, Moscow (RU)

( * ) Notice: Subject to any disclaimer, the term of this patent is extended or adjusted under 35 U.S.C. 154(b) by 0 days.

(21) Appl. No.: 09/675,885

(22) Filed: Sep. 29, 2000

Related U.S. Application Data

(63) Continuation of application No. PCT/RU98/00095, filed on Mar. 30, 1998.

(51) Int. Cl.[7] ..... B01F 3/04

(52) U.S. Cl. ..... 261/64.1; 261/81; 261/122.1; 261/DIG. 26

(58) Field of Search ..... 261/30, 81, 64.1, 261/122.1, DIG. 26, DIG. 48

(56) References Cited

U.S. PATENT DOCUMENTS

| | | | | | |
|---|---|---|---|---|---|
| 1,737,624 | A | * | 12/1929 | Thomson | 261/122.1 |
| 3,063,952 | A | * | 11/1962 | Vieli | 261/122.1 |
| 3,118,958 | A | * | 1/1964 | White | 261/122.1 |
| 3,322,684 | A | * | 5/1967 | Gibson et al. | 261/DIG. 26 |
| 3,346,033 | A | * | 10/1967 | Olejniczak | 261/122.1 |
| 3,855,368 | A | | 12/1974 | Prochazka et al. | 261/81 |
| 4,793,714 | A | * | 12/1988 | Gruber | 261/81 |
| 4,830,790 | A | | 5/1989 | Stevenson | 261/18.1 |
| 6,039,309 | A | * | 3/2000 | Kuklinski | 261/81 |

FOREIGN PATENT DOCUMENTS

| | | | | |
|---|---|---|---|---|
| DE | 3021606 | | 12/1981 | |
| FR | 2575082 | | 6/1986 | |
| GB | 572242 | * | 9/1945 | 261/81 |
| SU | 115374 | | 11/1958 | |
| SU | 216636 | | 12/1971 | |

* cited by examiner

*Primary Examiner*—C. Scott Bushley
(74) *Attorney, Agent, or Firm*—Yuri Kateshov

(57) ABSTRACT

A homogeneous foam is obtained by providing a plate formed with numerous capillary tubes which divide a gas stream into elementary gas components spaced equidistantly from one another upon entering a foaming composition. The gas stream is controllably interrupted to obtain a succession of gas doses supplied to the plate in a time and pressure-controlled manner; the plate is controllably displaced to allow gas bubbles to separate from the plate between consecutive gas doses.

12 Claims, 1 Drawing Sheet

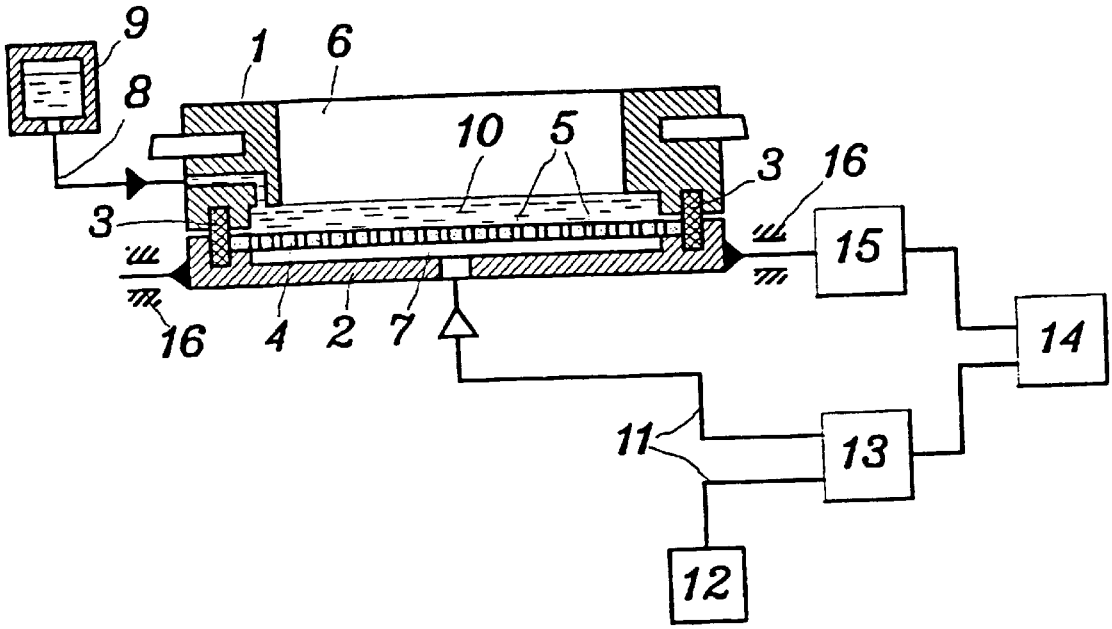
9
8
1
6
10
5
3
16
3
15
16
4
2
7
14
11
13
12

METHOD FOR PRODUCTION OF FOAM AND DEVICE FOR REALIZING THE SAME

CROSS REFERENCE TO RELATED APPLICATION

This application is a continuation application of PCT/RU98/00095 filed Mar. 30, 1998.

FIELD OF THE INVENTION

This invention relates to a method for producing foam, primarily utilized in a medical field and food industry, and to an apparatus for carrying out this method.

BACKGROUND OF THE INVENTION

Numerous methods for making foams used in medicine and food industry are known and, typically, include porous plates traversed by a gas which runs into a foaming medical solution. Typically, the pores are distributed within the plates in an irregular manner and have different dimensions and orientations with respect to a surface of the plates. Accordingly, a velocity of jets of gas passing through pores and an angle at which these jets enter the foaming solution vary. As a consequence, a common fluid bubble, which has a diameter varying from tens of micrometers to millimeters, may be formed at a downstream end of the pores. Foams manufactured in accordance with these methods typically are not reliable and tend to break apart within a short period of time.

Examples of the discussed above methods can be found in SU, A 865295 and RU, A 2051666 disclosing a vessel for a foaming liquid which houses a sprayer provided with a perforated plate and connected to a source of gas.

Another arrangement, as disclosed in SU, A 3644304, carries out a method wherein a perforated plate is traversed by numerous jets of gas, each of which enters into a foaming composition to simultaneously form a plurality of gas bubbles.

Overall, many known arrangements utilized to carry out methods for manufacturing a foam are substantially similar to one another except for slight variations in their structures and foaming compositions, which are used for producing foam. Accordingly, foams produced by these methods typically do not have a homogeneous structure.

SUMMARY OF THE INVENTION

It is therefore an object of the invention to provide a method for manufacturing a foam having a homogeneous structure, which is characterized by substantially uniformly dimensioned and regularly spaced apart gas bubbles.

Another object of the invention is to provide a device having a porous plate, displacement of which provides substantially simultaneous separation of a plurality of the gas bubbles from pores to obtain a homogeneous structure.

This is achieved by an inventive method for producing foam wherein a gas stream is interrupted to have discreet gas portions or doses a supply rate of which and a pressure at which these portions enter a foam-forming vessel are controlled. Each of the gas portions is divided into a plurality of uniformly dimensioned components by a porous partition mounted along a path of the gas stream. Furthermore, as a plurality of evenly spaced apart uniform gas bubbles are formed on the downstream surface of the partition, the latter is controllably displaced perpendicular to the path of the gas stream to provide a supplementary sheering force sufficient to separate the bubbles from the partition between consecutive gas doses. Please replace the originally filed specification with a substitute specification enclosed herewith.

Preferably, a supply frequency varies from 20 to 100 pulses per second, whereas duration of each pulse varies from 0.001 to 0.01 sec.

Also, the gas is supplied at flow rate ranging between 0.1–5.0 l/min and under a pressure between 0.09–15.5 atm.

It is preferable to create a supplementary pull for tearing of the bubbles by reciprocally displacing a porous partition.

An apparatus having a vessel which houses a porous partition dividing the vessel into two chambers carries out the inventive method. The porous partition has a plurality of uniformly dimensioned capillary tubes forming orifices on opposite sides of the plate, which are regularly spaced from one another. The apparatus further includes a gas source in flow communication with one of the chambers by means of a pipeline and a control unit for measuring a rate and pressure of gas stream in this pipeline.

Advantageously, the partition is made from a gas impervious material; the control unit mounted in the pipeline is a valve.

Preferably, a number of capillary tubes varies from 8 to 250 per square millimeter, wherein each individual tube has a diameter ranging between 0.02 and 0.16 millimeter.

It is contemplated within the scope of this invention to have a variety of interchangeable partitions, each of which has a unique number of and dimension of the orifices.

BRIEF DESCRIPTION OF THE DRAWINGS

The above and other objects, features and advantages will become more readily apparent from the following detailed description accompanied by a drawing, in which FIGURE is a diagrammatic view of an apparatus carrying out an inventive method.

DETAILED DESCRIPTION OF THE DRAWINGS

Referring to FIGURE, an inventive assembly has a vessel or barrel 1 provided with a sidewall and a bottom 2, which is displaceably attached to the sidewall in a hermetic manner by means of an elastic coupling 3. A perforated or porous partition 4 is detachably mounted to the bottom 2 to divide the barrel 1 into a chamber 7 communicating with a gas source 12 and a chamber 6 in flow communication with a foaming composition source 9 via pipelines 11 and 8, respectively. A gas-flow regulating element such as a valve 13 is installed in the pipeline 11 and is controlled by a control unit 14 to periodically interrupt the gas stream supplied to the partition 4. The control unit is also connected with an actuator 15 linked with the bottom 2 to controllably provide the latter with a reciprocal motion in a direction perpendicular to a gas flow path.

The inventive method for making foam is carried out in the following manner. The valve 13 interrupts a constant gas stream flowing along the pipeline 11 toward the partition 4 to form discreet gas doses at a frequency ranging from 20 to 100 pulses per second, wherein each of the gas doses lasts within a 0.001–0.01 sec period. The partition formed as a gas impermeable membrane is provided with a plurality of regularly spaced apart orifices or capillary tubes 5 dividing each gas dose into numerous homogeneous elementary gas components. Concentration of the orifices 5, which are uniformly dimensioned to preferably have their diameters varying between 0.02 and 0.16 mm, ranges from 8 to 250 per $mm^2$. The gas stream regulated by the valve 13 is supplied to the partition at a rate varying from 0.1 to 5.0 l/min and under pressure lying within a 0.09–15.5 atm interval. As a result of equally spaced apart orifices, the gas doses spaced at a regular distance from one another enter the foaming composition accumulated in the chamber 6 at time-controlled intervals which correspond to open states of the valve 13. As the gas jets penetrate a dense foaming composition, their trailing or upstream ends are still in contact with the surface of the partition. To completely separate the gaseous formations from the orifices 5 and to form evenly distributed bubbles in the foam, the control unit 14 actuates the actuator 15 to reciprocally move the partition perpendicular to a path of the gas stream. As a result, a sheering force generated by the movement of the partition is sufficient to provide separation of the trailing ends of gaseous formations, whereas their leading ends practically remain unaffected by this movement. Accordingly, orientation of the bubbles with respect to the surface of the partition and to one another in the foam remains undisturbed. By controlling gas flow rates and time intervals of the open state of the valve as well as displacement of the partition between consecutive gas doses, a size of the bubbles and a distance at which bubbles of consecutive gas dose are spaced apart in the foam are easily adjusted. Therefore, the method has a cyclical character wherein each cycle includes supplying a gas dose to the partition and subsequently moving the latter to form foam, after which the movement of the partition ceases. Preferably the assembly operates in such a manner that from 20 to 100 cycles are performed within a second. Control unit 14 turns on the actuator, which provides displacement of the partition, only between successive gas doses.

After desirable values of flow rate and pressure have been set, the assembly carries out the above-disclosed method in accordance with the following sequence of operations. Upon delivering the foaming composition into the vessel, the control unit monitors the operation of the valve 13 in accordance with the stored parameters to deliver a predetermined volume of the gas stream to the partition 4. As the desired volume of gas has passed through the capillary tubes 5 of the partition, the valve is closed and the actuator 15 is turned on to displace the partition, thereby forming gas bubbles. Once a cycle has been completed, the following cycle analogous to the previous one starts.

In accordance with one embodiment of the invention, the control means includes electronics, whereas the valve and actuator include electromagnets.

In accordance with another embodiment of the invention, the control unit is a mechanical assembly, such as a camshaft, which has radial cams actuating both the valve 13 and actuator 15.

The radial cams are so shaped that they are capable of providing movements of the partition 1 and closing and opening of the pneumatic valve 13, respectively, in such a manner that the gas stream is delivered to the partition at a predetermined rate and volume.

The following data presented in table 1 indicates that the inventive method provides excellent results.

As will be seen from the table, a parameter $\xi$ characterizing stability of foam obtained in accordance with the inventive method is compared to the known prior art.

The best results have been obtained in example 1, wherein $\xi_1$=20. As can be seen from example 2, also carried out in accordance with the disclosed invention, $\xi_2$=20. By comparison, results shown in example 3 where $\xi_3$=1 have been obtained in accordance with the known prior art. Note that all parameters used in tests are mutually dependent.

| Value of indice | example 1 | example 2 | example 3 |
|---|---|---|---|
| | Tests | | |
| Diameter of the capillary tube, mm | 0.04 | 0.1 | middle 0.05 |
| Density, items per square mm | 36 | 14 | middle 45 |
| Total quantity of the capillary tubes | 55000 | 22000 | about 75000 |
| Gasflow rate, l/min | 0.4 | 0.39 | 0.29 |
| Pressure of the gas, atm | 4.2 | 2.2 | 2.0 |
| Quantity of impulses per second | 40 | 64 | absent |
| Length of the impulse second | 0.0083 | 0.144 | 0.5–2.5 |
| | Results | | |
| Diameter of bubbles, mm | 0.125 | 0.144 | 0.5–2.5 |
| Dispersivity of the foam | 8 | 6.9 | 0.4 |
| | $_1$ = 20 | $_2$ = 17 | $_3$ = 1 |

The present invention is not limited to the illustrated embodiment, but rather construed in breath and scope in accordance with recitation of the appended claims.

What is claimed is:

1. A method for making a foam comprising the steps of:

(a) periodically interrupting a gas stream flowing along a path toward a vessel which is filled with a foaming composition and provided with a perforated partition, thereby forming a succession of pulsed gas doses;

(b) dividing each of the gas doses upon encountering the perforated partition into numerous elementary gas components entering the foaming composition to form equidistantly spaced apart gas bubbles;

(c) displacing the perforated partition perpendicular to the path of the gas stream between consecutive gas doses to separate the gas bubbles from the perforated partition, thereby forming a plurality of uniformly dimensioned gas bubles in the foam; and (d) repeating steps (b) and (c).

2. The method defined in claim 1, further comprising the steps of controlling a supply frequency of the pulsed gas doses delivered toward the perforated partition and a time interval of an individual gas dose, said supply frequency ranging between 20 and 100 pulses per second and the time interval varying from 0.001 to 0.01 sec.

3. The method defined in claim 1, further comprising the steps of controlling a flow rate, at which the gas doses are delivered toward the perforated partition, and a gas pressure, said flow rate being at least 0.1 l/min and at most 5 l/min and said gas pressure ranging from 0.09 to 15.5 atm.

4. The method defined in claim 1 wherein the perforated partition is reciprocally displaced to provide oppositely directed sheering forces.

5. An apparatus for making foam comprising:

a source of gas streaming along a path;

a vessel downstream from the source of gas;

a valve between the source of gas and vessel periodically interrupting the gas stream to provide a succession of gas doses pulsed toward the vessel along the path;

a perforated partition mounted in the vessel and provided with a plurality of capillary throughgoing tubes spaced from one another at a regular distance and having a uniform cross-section to divide each of the gas doses into gas components entering a foaming composition downstream from the partition to form evenly spaced apart gas bubbles; and an actuator reciprocally displacing the perforated partition perpendicular to the path between consecutive gas doses to separate gas bubbles from a surface of the partition, so that the separated gas bubbles have the same dimensions.

6. The apparatus defined in claim 5 wherein the partition is a gas permeable membrane.

7. The apparatus defined in claim 5, further comprising a control unit opening said valve at predetermined regular time intervals to provide separate gas doses and turning on the actuator to displace the partition between consecutive gas doses.

8. The apparatus defined in claim 5 wherein concentration of the capillary tubes varies from 8 to 250 items per $mm^2$.

9. The apparatus defined in claim 5 wherein the cross-section of the capillary tubes has a diameter varying from 0.02 to 0.16 mm.

10. The apparatus defined in claim 5 wherein the partition is detachably mounted to the vessel.

11. The apparatus defined in claim 7 wherein the control unit is an electronic control unit.

12. The apparatus defined in claim 7 wherein the control unit is a mechanical control unit including a camshaft which is provided with two cam followers actuating the valve and actuator, respectively.

* * * * *